US005383410A

United States Patent [19]

Mukai et al.

[11] Patent Number: 5,383,410

[45] Date of Patent: Jan. 24, 1995

[54] AUTOMATIC APPARATUS FOR HEMMING A TUBULAR WORKPIECE

[75] Inventors: Hirochika Mukai; Tomoyuki Nakajo; Toshihito Negoro, all of Osaka, Japan

[73] Assignee: Pegasus Sewing Machine Mfg. Co., Ltd., Osaka, Japan

[21] Appl. No.: 171,736

[22] Filed: Dec. 22, 1993

[30] Foreign Application Priority Data

Apr. 21, 1993 [JP] Japan ..... 5-094380

[51] Int. Cl.[6] ..... D05B 35/02; D05B 35/10

[52] U.S. Cl. ..... 112/63; 112/143; 112/153; 112/306

[58] Field of Search ..... 112/121.11, 141, 143, 112/63, 147, 121.26, 304, 306, 153, 305, 2, 318, 322

[56] References Cited

U.S. PATENT DOCUMENTS 4,664,048 5/1987 Naganuma ..... 112/306 X
4,883,005 11/1989 Wehmeyer ..... 112/63
4,967,674 11/1990 Rohr et al. ..... 112/63
5,097,777 3/1992 Porter ..... 112/306
5,271,347 12/1993 Fontcuberta ..... 112/63 X

*Primary Examiner*—Peter Nerbun
*Attorney, Agent, or Firm*—Jones, Tullar & Cooper

[57] ABSTRACT

An automatic hemming apparatus for supplying a tubular workpiece in an adequate attitude to a sewing machine (4) is disclosed. The apparatus has a workpiece position control device (21) and a guide (19) for folding a circular edge of the workpiece in front of a sewing bed (6). The sewing machine (4) is provided with a delivery roller (10) at the rear side and an assisting feed belt (26) at the outside of the sewing bed (6). The device (21) comprises an edge sensor (17) and inclined freely rotatable rollers (22A to 22D) so as to contact with the workpiece on the outer surfaces thereof. On the feeding operation of roller (10) and belt (26), according to a signal from the sensor (17), a stepping motor (24) changes the inclining direction of the rollers (22A to 22D) and the workpiece is moved toward the right or left.

5 Claims, 13 Drawing Sheets 4
12
15
14
3
2
1
37
b
18
37
19
17
57
51
A
10
13
16
30
6
33
26
34
8
21
35
53
52
36
38

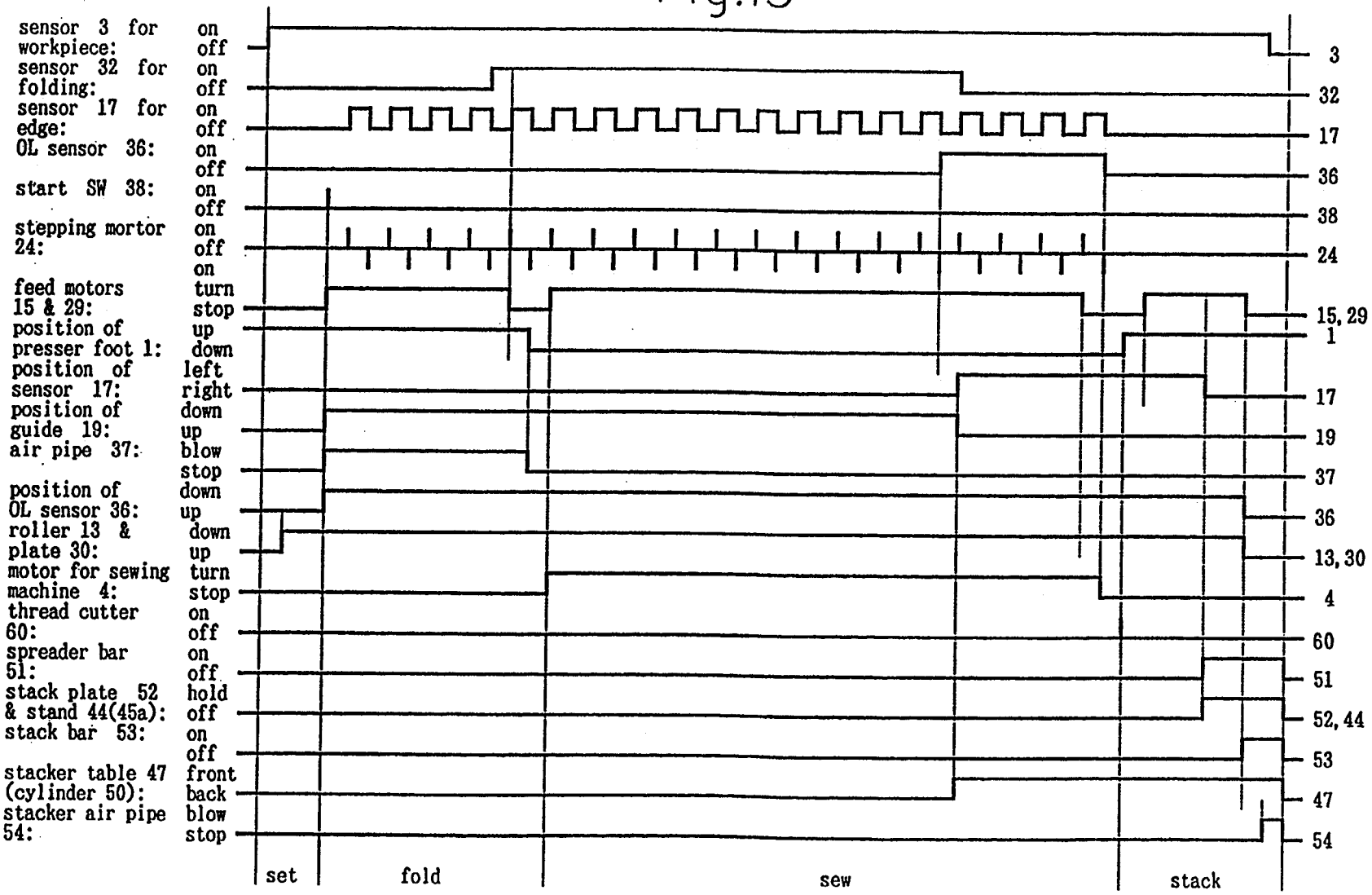
Fig.13
sensor 3 for workpiece:
sensor 32 for folding:
sensor 17 for edge:
OL sensor 36:
start SW 38:
stepping mortor 24:
feed motors 15 & 29:
position of presser foot 1:
position of sensor 17:
position of guide 19:
air pipe 37:
position of OL sensor 36:
roller 13 & plate 30:
motor for sewing machine 4:
thread cutter 60:
spreader bar 51:
stack plate 52 & stand 44(45a):
stack bar 53:
stacker table 47 (cylinder 50):
stacker air pipe 54:
on
off
turn
stop
up
down
left
right
blow
hold
front
back
3
32
17
36
38
24
15, 29
1
19
37
13, 30
4
60
51
52, 44
53
47
54
set
fold
sew
stack

AUTOMATIC APPARATUS FOR HEMMING A TUBULAR WORKPIECE

BACKGROUND OF THE INVENTION

The present invention relates to an automatic hemming apparatus for tubular workpieces such as T-shirts, underwears, jogging shorts, free-size skirts and pants. When a tubular workpiece is supplied to the apparatus, a bottom edge of the workpiece is folded over to the inside, and the folded edge is automatically sewn or "hemmed" between a feed dog provided in a sewing bed and a presser foot facing thereto.

In a hemming apparatus for tubular workpieces of this type, it is technically most important that a folded edge of the workpiece is guided to a position spaced from a sewing needle by a predetermined distance, and adequately controlled in position so that a seam is formed in parallel with the edge, and those disclosed, for example, in Japanese Laid-Open Patent Nos. 2-95396, 4-256780, 4-256781, 2-23987 and Published Patent No. 1-1155 and U.S. Pat. No. 4,825,787 are known as such apparatuses. In the cited references, various position control technologies are disclosed for detecting an offset of the edge by a photoelectric sensor, and forcing the edge to an appropriate position according to the amount of the offset detected.

Such conventional hemming apparatuses for tubular workpieces, however, are semi-automatic, and such assisting operations of manually leading and keeping the workpiece by an operator are indispensable in order to ensure that the edge of workpiece is guided to a predetermined position. Because such assisting operation is manually performed for guiding the edge of a workpiece, the operating (sewing) efficiency is insufficient, and it also requires a certain level of experiences and skills.

SUMMARY OF THE INVENTION

Hence, it is a first object of the invention to provide a hemming apparatus for tubular workpieces that only requires a tubular workpiece to be supplied over a sewing bed thereof, without resort to any manual work thereafter, folds over an edge of the workpiece along a predetermined position, and adequately sews along the folded edge for significantly increasing the operating efficiency and productivity.

It is another object of the invention that one operator easily handles two apparatus at the same time by providing a unique motion in a stacker for stacking hemmed tubular workpieces.

An automatic hemming apparatus according to the invention comprises a sewing bed with a feed dog incorporated therein, support members for a tubular workpiece placed horizontally in front and rear sides of the bed, respectively, a workpiece feeder for feeding the workpiece supplied over the front and rear support members from the front side to rear side along the sewing bed, an edge detecting sensor for detecting a circular edge of the tubular workpiece supplied over the support members, a workpiece guide placed between the sewing bed and the front support member for folding over the circular edge of tubular workpiece that is fed by the workpiece feeder to the inside and a workpiece position controller provided near the front support member for transporting the circular edge of tubular workpiece in the direction across the feeding direction of workpiece. An assisting workpiece feeder belt is employed outside the sewing bed for feeding the workpiece in the direction identical to that of the workpiece feeder. The workpiece position controller comprises a plurality of freely rotatable rollers placed parallel with each other in the direction perpendicular to the feeding direction of workpiece. The freely rotatable rollers are positioned such that a circumferential surface thereof is inclined at an angle to the feeding direction of workpiece, and serves for transporting the workpiece to the right or left directions by rotating with the circular surface being in contact with the workpiece. The angle of the plurality of freely rotatable rollers is changed by a roller angle changing mechanism according to a detection signal from the edge detecting sensor.

In order to stack workpieces that are hemmed and removed from the apparatus, a stacker is additionally provided. The stacker comprises and a mechanism for shifting a workpiece receiving table from a standby position outside and backwardly remote from the sewing bed to a position opposing to the sewing bed and a mechanism for shifting it from the opposing position to a position for receiving the tubular workpieces. Thus the traveling motions of the receiving table are repeated for hemmed each workpiece.

In the apparatus of the invention, a folding confirmation sensor for detecting that the circular edge is folded over and a driving member for moving said edge detecting sensor to a position for detecting a folding line according to a detection signal of the folding confirmation sensor are available and employed for position control of workpiece in a sewn portion.

In the invention, by initiating the operation after supplying a tubular workpiece over the support members by an operator, the workpiece feeder and assisting workpiece feeder belt are activated, the tubular workpiece is transported from the front to rear side along the sewing bed. During the transportation, a position of circular edge of the workpiece is detected by the edge detecting sensor, the angle of the plurality of freely rotatable rollers are changed according to a detection signal thereof, and the workpiece contacting on the circular surface of rollers is controlled in a specified position to the edge detection sensor, for example, like a steering front wheel of a vehicle. Simultaneously, by the assisting workpiece feeder belt, the workpiece is prevented from escaping outside due to its own weight, folded over inside with the edge along a predetermined position by the workpiece guide without any other guiding operation by the operator, and sewed at the predetermined position in the folded edge, and hemming is, thus, fully automated.

Furthermore, as the mechanism for changing the angle of rollers, a stepping motor is used with a shaft thereof connected to support arms of the freely rotatable rollers by a link and then the position control of workpiece may be done without delay to the advance of workpiece. In addition, a liftable belt cover plate provided outside the assisting workpiece feeder belt allows the workpiece to be supplied or removed smoothly over the bed without being obstructed by a side edge of the belt.

When the workpiece sewn in such manner is removed outside from the apparatus, the workpiece receiving table in the stacker receives the workpiece in a position adjacent to the sewing bed. Then, once the workpiece is received, as the table is diagonally moved from the receiving position, and stopped at the standby position outside and backwardly remote from the apparatus, a sufficient space for the operator is secured in a location facing the outside of sewing bed during a sewing operation, thus, the operator is allowed to easily operate two automatic hemming apparatus simultaneously, and the productivity can be increased.

Above and the other objects and novel features of the invention will be more clearly understood hereinbelow by reading a detailed description of embodiment. However such embodiment is shown only as an example, and not limiting the scope of the invention.

BRIEF DESCRIPTION OF THE DRAWINGS

FIG. 13 is a time chart showing an operation of the embodiment of the automatic hemming apparatus.

DETAILED DESCRIPTION OF THE PREFERRED EMBODIMENT

Figure 1:
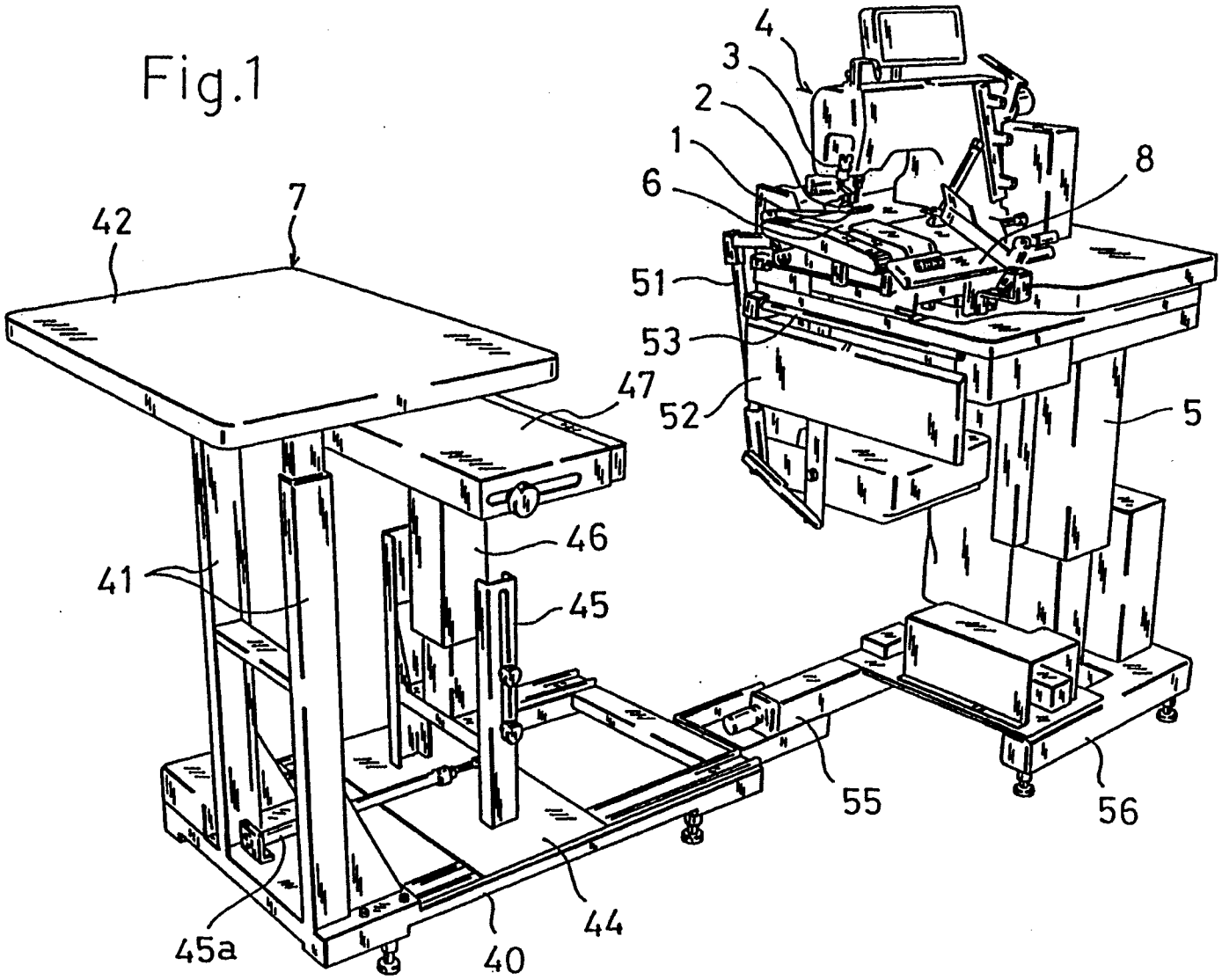
FIG. 1 is an overall perspective view showing an embodiment of an automatic hemming apparatus for tubular workpieces.

Referring to FIG. 1, a flat type sewing machine 4 for covering chain stitch provided with a presser foot 1, sewing needle 2 and workpiece sensor 3 comprises a sewing bed 6 settled on a support table 5 and a stacker 7 placed opposite to the sewing bed 6 outside thereof.

Figure 7:
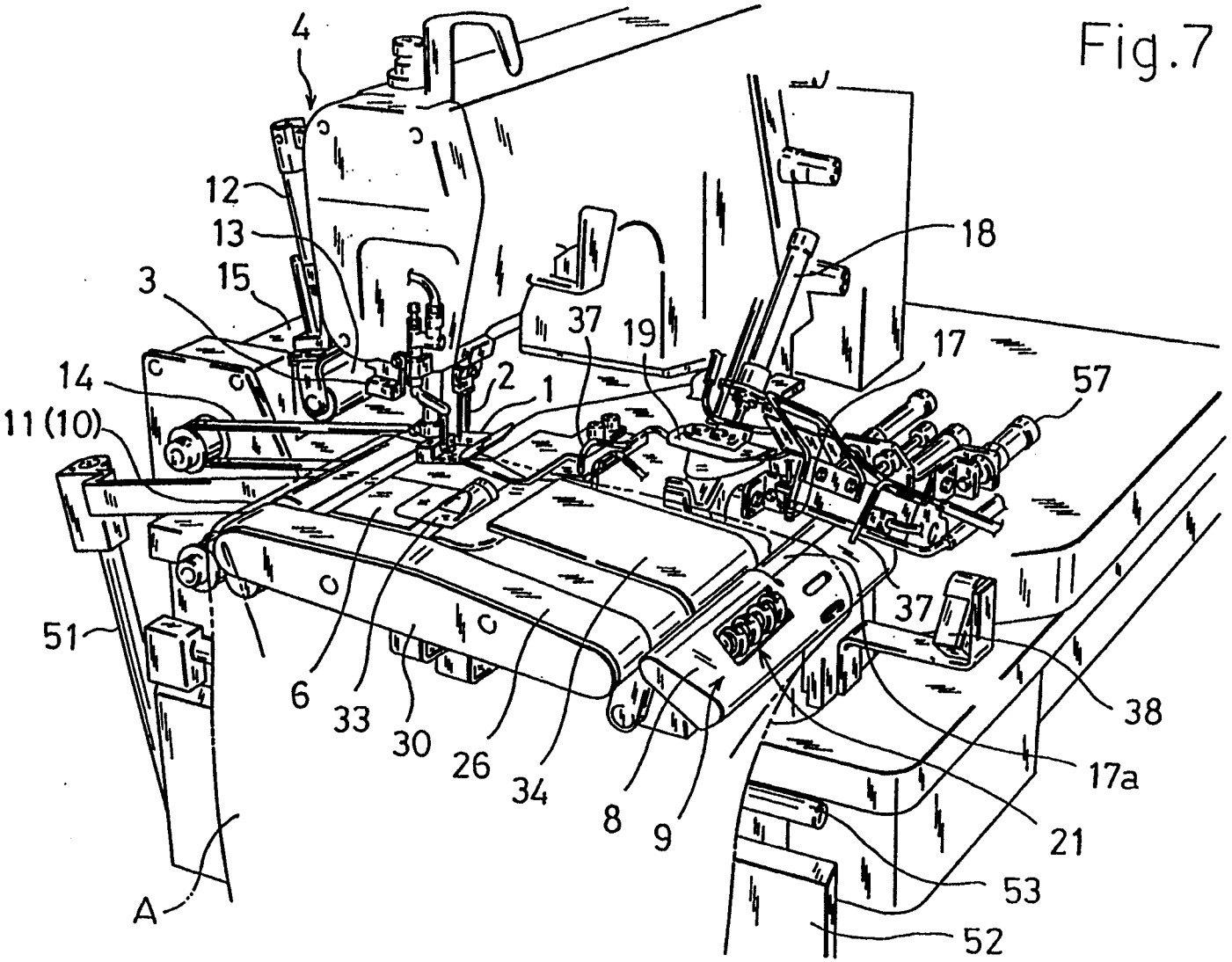
FIG. 7 is a perspective view showing the tubular workpiece applied and set to the apparatus.
Figure 8:
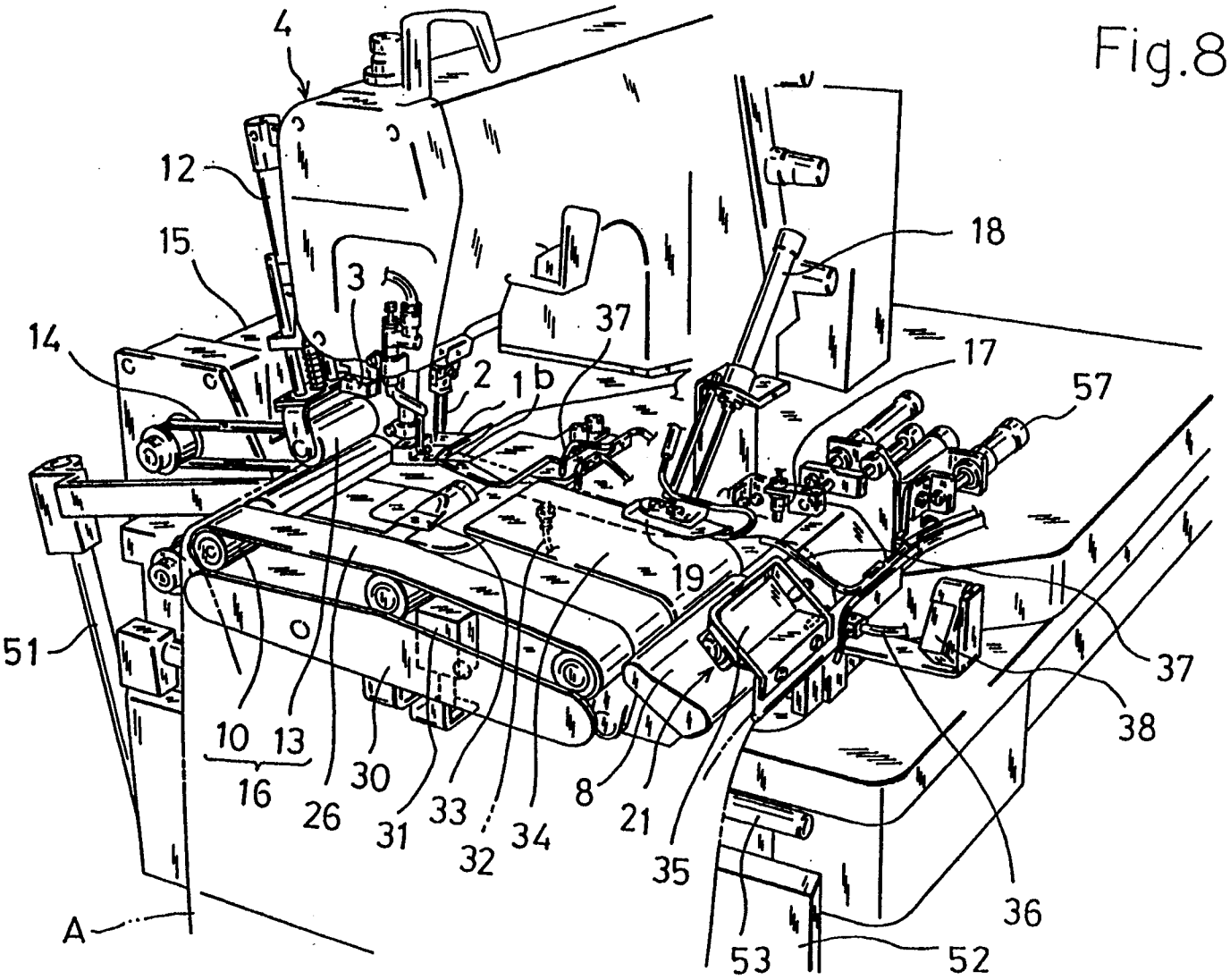
FIG. 8 is a perspective view showing the tubular workpiece advanced with its circular edge being folded over.
Figure 9:
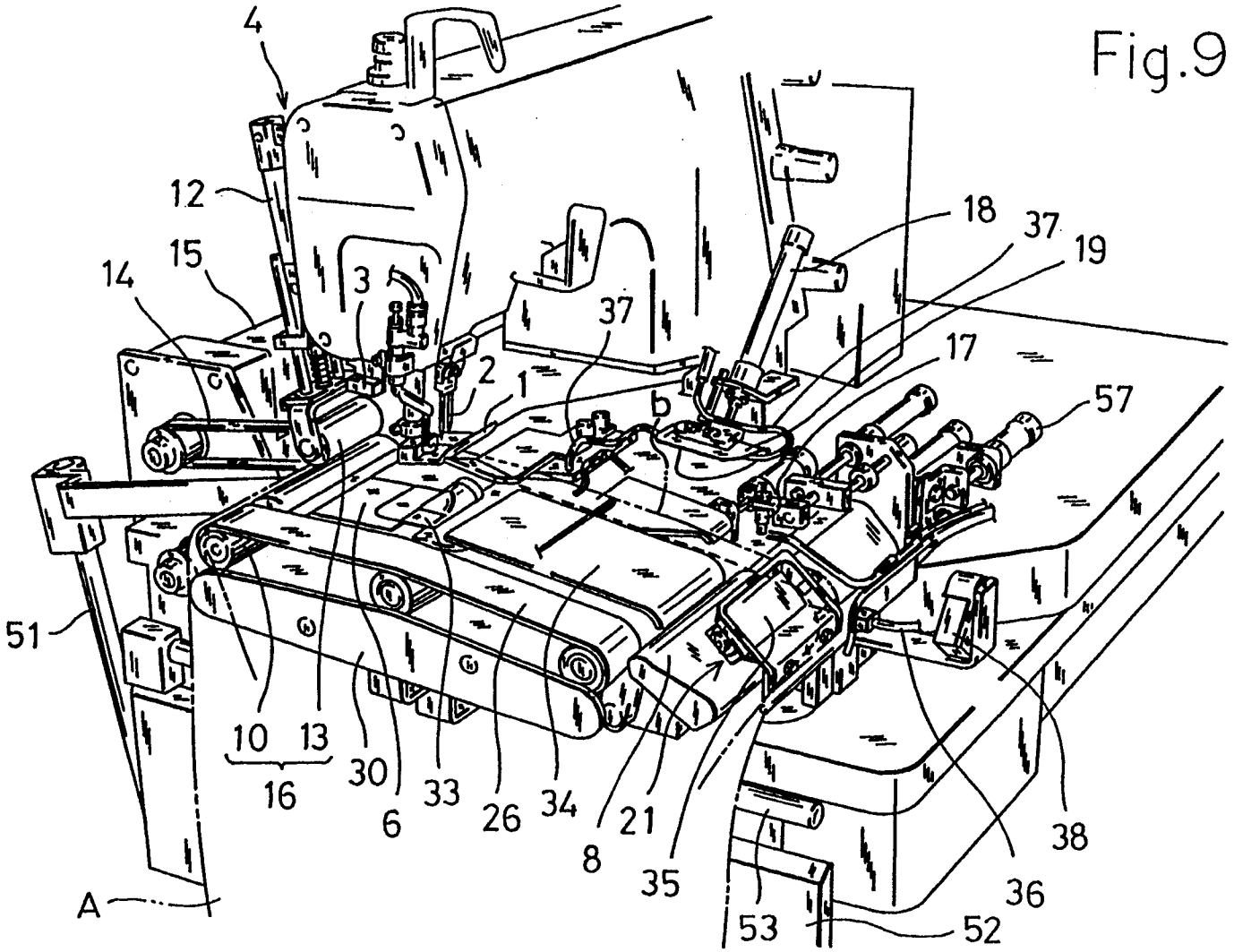
FIG. 9 is a perspective view showing the tubular workpiece with its circular edge being hemmed.

A flat tubular cover 8 is positioned and fixed to the front side of the sewing bed 6, as shown in FIGS. 7 to 9, for attaching an edge position controller which will be described later, and a curved outer surface of the cover 8 forms a front support member 9 for a tubular workpiece A supplied thereover. In addition, a rear roller 10 is pivotally supported for rotation on the rear side of the sewing bed 6, and the circumferential surface of the rear roller 10 forms a rear support member 11 for the tubular workpiece A applied thereover.

Figure 2:
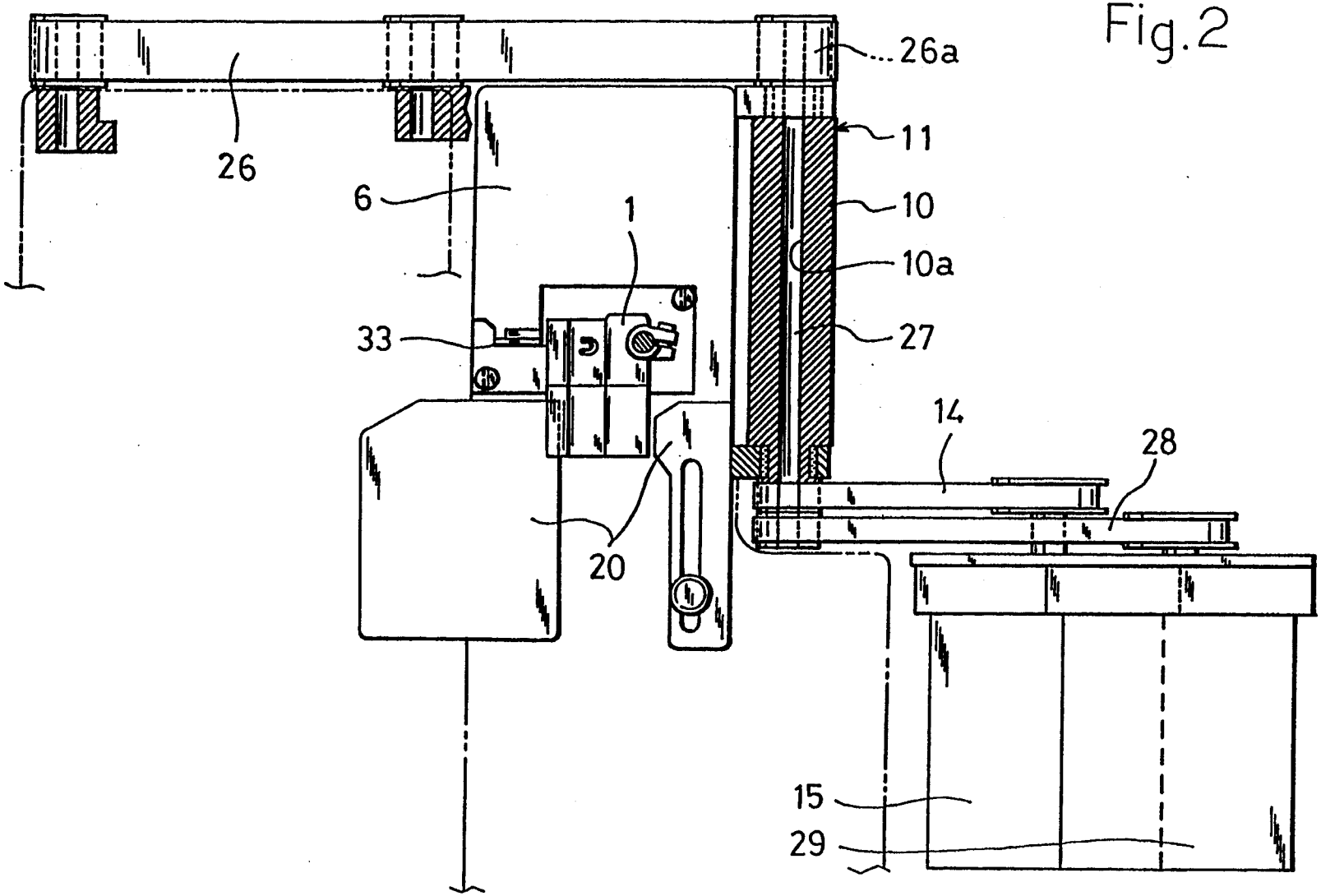
FIG. 2 is a partly cutaway magnified plan view showing main parts of the embodiment.
Figure 4:
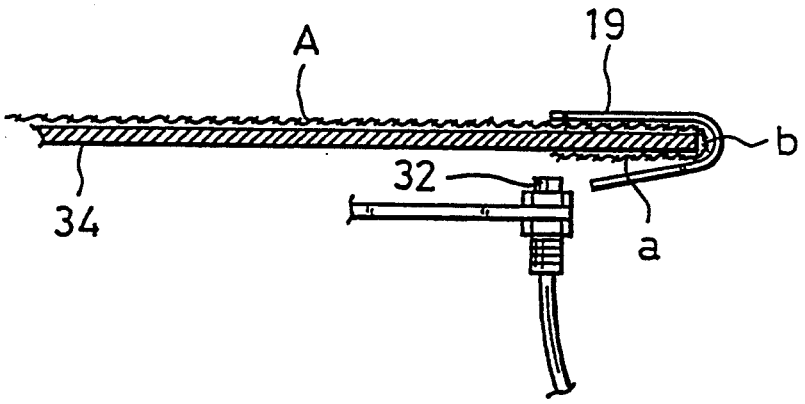
FIG. 4 is a magnified vertical sectional view for explaining an operation of a workpiece guide and a folding confirmation sensor.

In an upper position opposite to the rear roller 10, a nip roller 13 is employed and driven vertically by a cylinder 12 toward and away from the circumferential surface of the rear roller 10, and the rear roller 10 is associated with a first feed motor 15 via a belt 14. The rear roller 10 and nip roller 13 constitute a workpiece feeder 16 for transporting the tubular workpiece A applied over the front and rear support members 9, 11 from the front to rear side interlocking with the feed of the sewing machine 4. An edge detecting sensor 17 is provided for detecting a bottom edge of the workpiece A in a forward position aside a transporting path of the workpiece A. A workpiece guide 19 is provided at a rear side of the sensor 17 and retractively shifted by means of an air cylinder 18 between an operating position (FIG. 8) and a non-operating position (FIGS. 7 and 9). When projected to the operating position, the workpiece guide 19 folds down and turns over the bottom edge "a" of the workpiece A as shown in FIG. 4. In FIG. 2, a reference numeral 20 indicates a guide for directing a folded line "b" of the workpiece A that is folded down and turned over to the inside, and numeral 33 shows a hooked knife vertically moved for cutting the folded bottom edge "a" in uniform width. In FIG. 4, a reference numeral 32 shows a folding confirmation sensor for detecting the bottom edge "a" of workpiece A located in a lower part of a guide base 34 sits in front of the sewing bed 6.

Figure 3:
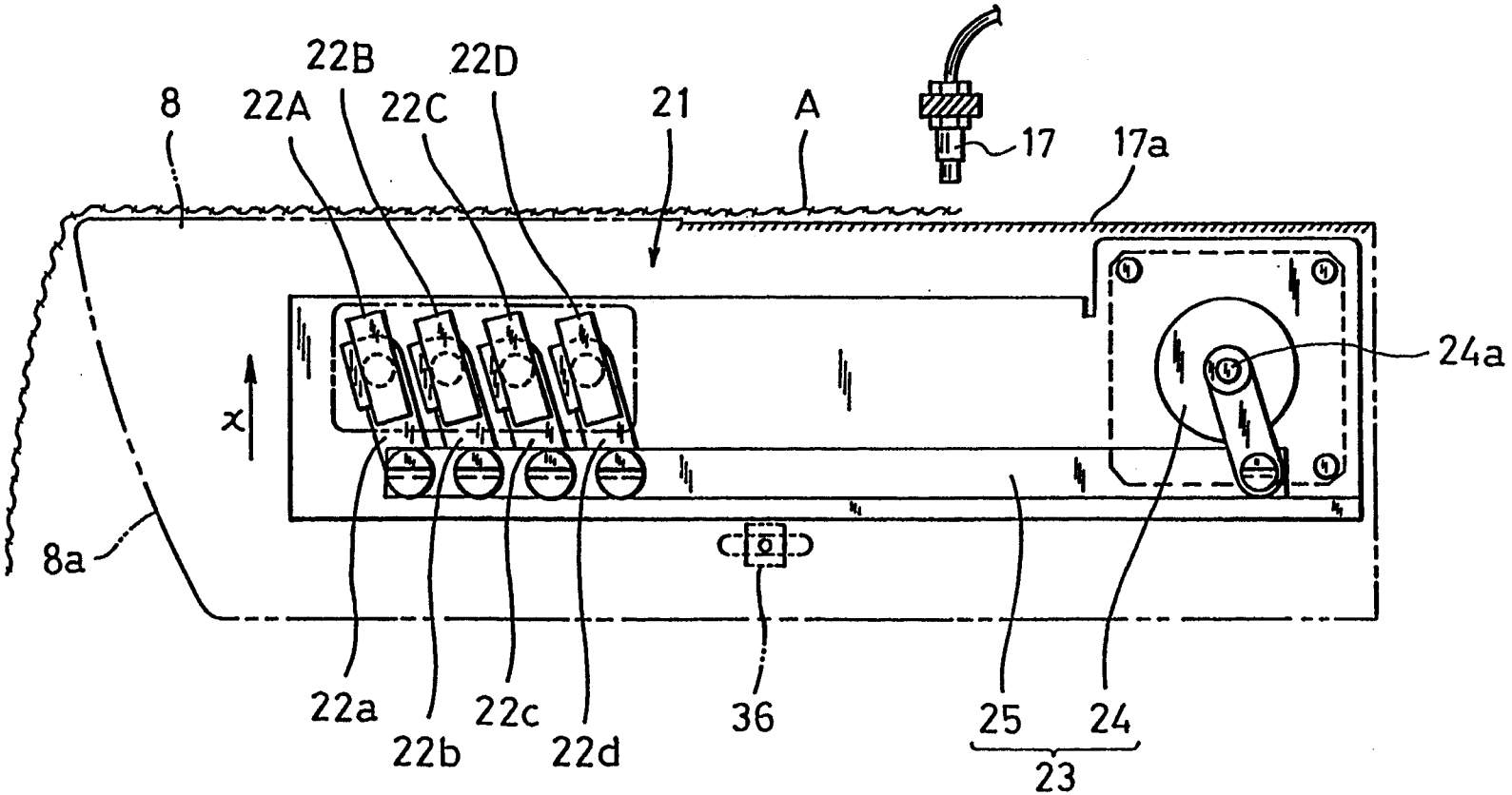
FIG. 3 is a front view showing main parts of a workpiece position controller.

The edge position controller incorporated in the flat tubular cover 8 is shown by a numeral 21. It comprises, as clearly shown in FIG. 3, a plurality (four, in the embodiment, but they may be either three or five or more) of freely rotatable rollers 22A to 22D positioned in parallel with each other with an appropriate spacing between them along the direction perpendicular to the feeding direction of workpiece that is depicted by an arrow x and a roller angle changing mechanism 23 for changing an inclination of the plurality of freely rotatable rollers 22A to 22D against the feeding direction x of workpiece, and serves for controlling the position of the workpiece in the direction across the feeding direction x. The roller angle changing mechanism 23 in the edge position controller 21 comprises a stepping motor 24 rotated reversibly according to a detection signal of the edge detecting sensor 17 and a link 25 for connecting a driving shaft 24*a* of the stepping motor 24 with support arms 22*a* to 22*d* pivotally supporting the freely rotatable rollers 22A to 22D about an axis perpendicular to the rotating axis thereof. An outer circumferential surface of the freely rotatable rollers 22A to 22D is covered by a member having a high coefficient of friction such as a rubber. In addition, a pressure plate 35 formed by a plate spring is employed for forcing the workpiece A to be in contact with the circumferential surface of rollers 22A to 22D. In FIG. 3, when the tubular workpiece A is present between the edge detecting sensor 17 and a reflecting plate 17*a*, the freely rotatable rollers 22A to 22D are oriented in the upper leftward direction, as shown in the figure, and guide the workpiece A in the leftward direction, then, when the workpiece A is no more present between the sensor 17 and reflecting plate 17*a*, the stepping motor 24 is rotated clockwise, and changes the orientations of freely rotatable rollers 22A to 22D to the upper rightward direction.

In the outside of the sewing bed 6, an assisting workpiece feeder belt 26 is further provided for feeding in the direction identical to that of the workpiece feeder 16 (10, 13). As clearly shown in FIG. 2, the assisting workpiece feeder belt 26 is constructed such that a rotating axis 27 with a pulley 26*a* fixed thereto in the rear side in the feeding direction is passed through a bore 10*a* formed in a central part of the rear roller 10, an end of the projected axis is associated with a second feed motor 29 by means of a belt 28, and the feeding speed can be changed in relation to the rear roller 10 by controlling rotation of the second feed motor 29. The feeder belt is formed in an outer circumference thereof by a material having an uneven surface and high coefficient of friction for providing a higher efficiency in feeding workpieces. Outside of such assisting workpiece feeder belt 26, a belt cover plate 30 lifted by an air cylinder 31 is placed, so that the workpiece A can be smoothly set without being obstructed by the uneven surface of the feeder belt by lifting the cover plate 30, when applying the workpiece A.

Moreover, an overlap detecting sensor (hereinafter OL sensor) 36 is employed in the vicinity of the front support member 9 for detecting arrival of a leading end of the folded edge "a" of the workpiece A according to a quantity of light passing therethrough. As the folded edge "a" of the workpiece A is hemmed almost completely over the entire circumference thereof, and the leading end of the folded edge "a" reaches the detecting position of the OL sensor 36, an air cylinder 57 is activated, the detecting position of edge detecting sensor 17 is shifted leftward, and movement of the workpiece A is thereafter controlled according to a position of the folding line "b" in the workpiece A. And a sewing time (or the number of stitches) for the remaining part is determined according to a signal from the OL sensor 36. In addition to the components mentioned above, plural air blowers 37 are employed, if required, for assisting the folding operation and preventing the workpiece A from curling, and the air blowers 37 and OL sensor 36 are arranged so as to be shiftable between an operating position and standby position by means of the air cylinder 57. A start switch 38 is placed in the foremost position of the sewing section.

Here, the stacker 7 is constructed in the following manner. As shown in FIG. 1, a stock table 42 for blank workpieces is attached so as to be vertically slidable and fixable to an upper end of a pair of cylindrical support legs 41 provided uprightly from a base frame 40. On guide rails 43 formed on both side of the base frame 40 and extended toward the sewing apparatus, as shown clearly in FIG. 6, a movable stand 44 slided by an air cylinder **45*a* is placed, and a pair of support legs 45 for workpiece receiving table is provided uprightly on the movable stand 44. Between the pair of support legs 45 for workpiece receiving table, a lift support leg 46 in a square columnar shape is located with a ball and screw type driving mechanism (not shown) incorporated therein for lowering the table at a constant rate as each workpiece is stacked thereon, and a workpiece receiving table (stacker table) 47 for stacking hemmed workpieces is mounted on an upper end of the lift support leg 46**.

Figure 5:
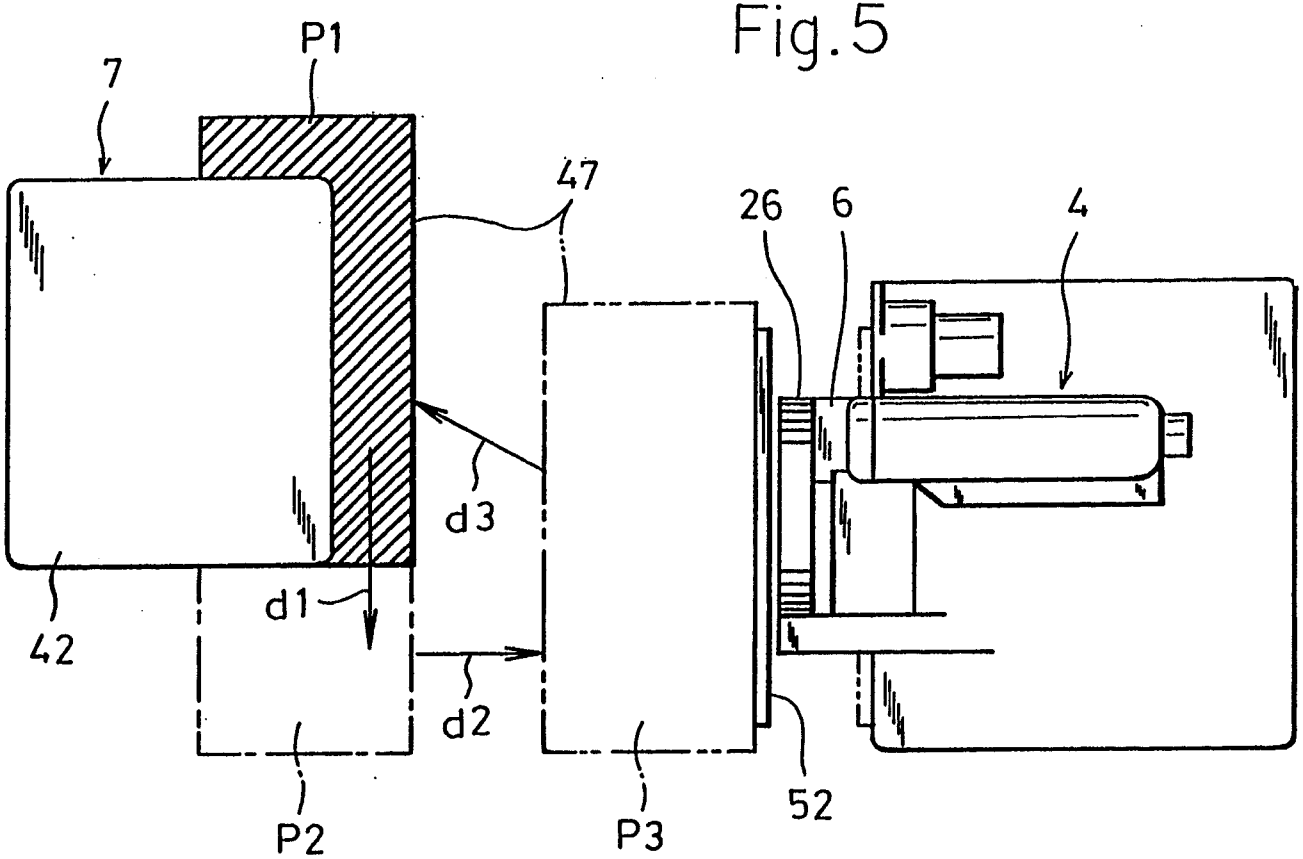
FIG. 5 is a schematic plan view explaining a movement of a stacker table to a sewing machine.
Figure 6:
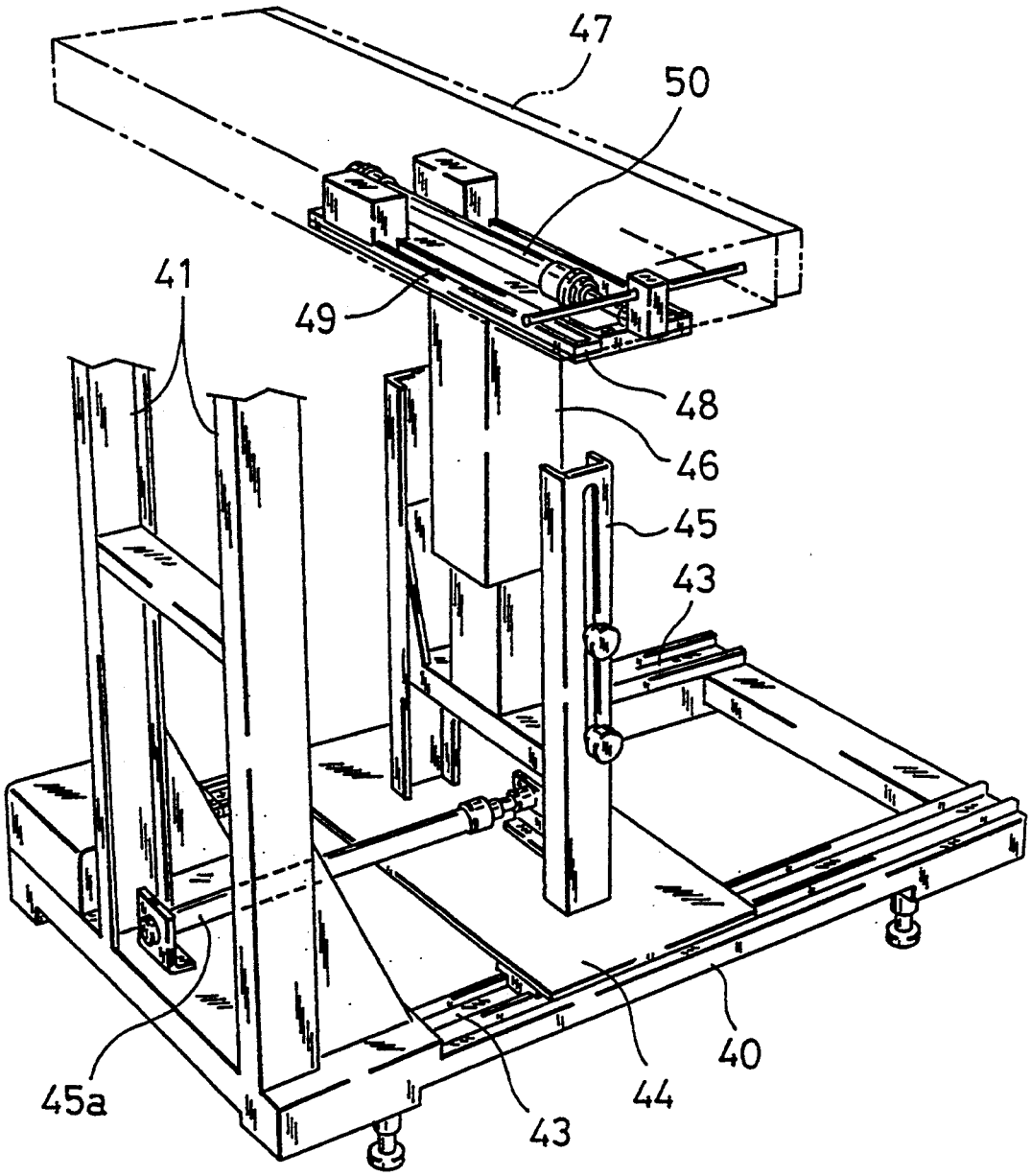
FIG. 6 is a partly cutaway perspective view showing a stacker table.

As shown in FIG. 6, the stacker table 47 is constructed so as to be shiftable in the direction parallel to the feeding direction of workpiece by means of a rail 49 and an air cylinder 50 in relation to a base plate 48 that is fixed in an upper end of the lift support leg 46. By being constructed in such manner, the stacker table 47 is adapted to be repetitively operated in cyclic steps in every hemming operation of the workpiece A, with a standby position (home position) P1 outside and backwardly remote from the sewing apparatus, as shown by hatching in FIG. 5, such that it is moved in the direction reverse to the feeding direction by the air cylinder 50 in step 1, as shown in an arrow d1, from the position P1 to a position P2 opposing to the outside of sewing machine 4, then, toward the sewing machine by the air cylinder **45*a* in step 2, as shown in an arrow d2, from the opposing position P2 to a position P3 for receiving the workpiece A to be removed from the hemming apparatus, and from the receiving position toward the home position P1 by means of a combined action of both air cylinders 50 and 45*a* in step 3**, as shown in a slanting arrow d3.

Because the stacker table 47 is provided for stacking and holding a plurality of workpieces A, it is required to be stopped in the step 2 in a position slightly offset in succeeding cycles, and such structure using a spring and eccentric as suggested in Japanese Utility Patent No. 60-38467 is incorporated for the purpose of shifting the stop position of the table 47 slightly backwardly in every succeeding cycle, which is, however, of a prior art, and is not described in detail here.

Figure 11:
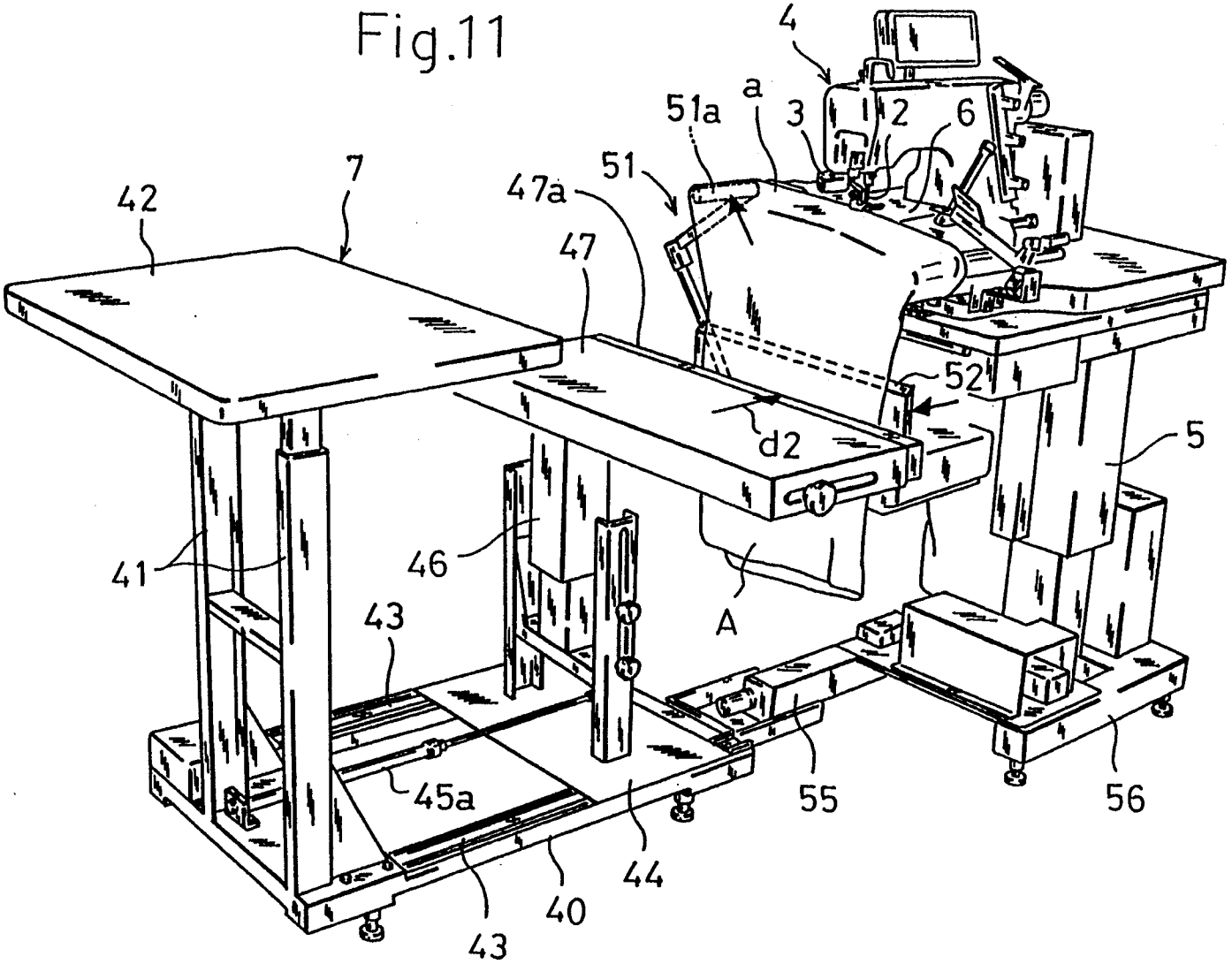
FIG. 11 is an overall perspective view for explaining an operation of the stacker in a second step.
Figure 12:
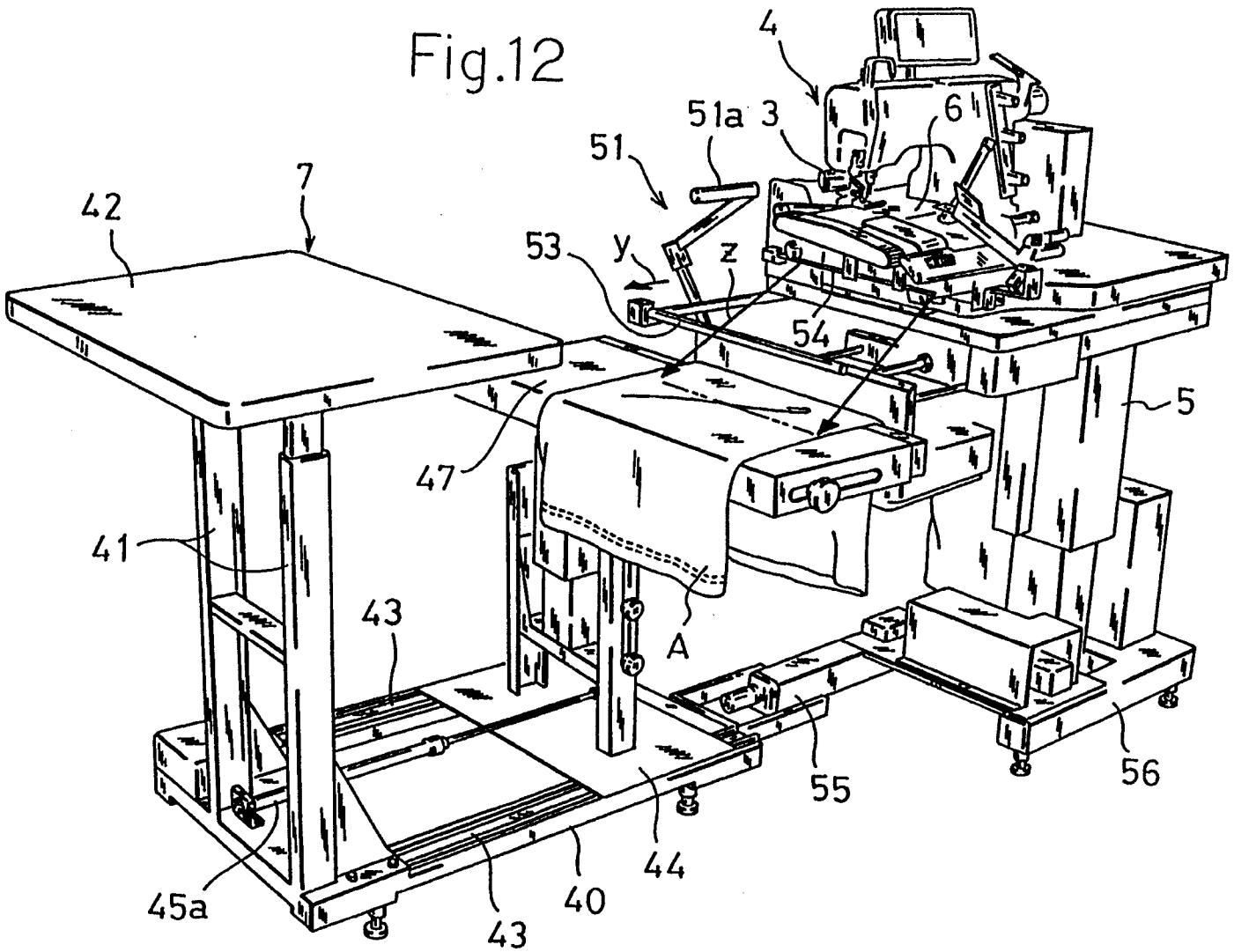
FIG. 12 is an overall perspective view for explaining an operation of the stacker in a third step.

As most clearly shown in FIGS. 11 and 12, in correspondence with the stacker 7 of such structure, a workpiece spreader device 51 operating for further spreading a rear end of tubular workpiece A, which has been already hemmed, in the backward direction, a stack plate 52 retractable in the inside and outside directions below the sewing bed 6 for pressing, when it is projected, an intermediate portion of the tubular workpiece A against an inside edge **47*a* of stacker table 47 in the stacker 7, a stacker bar 53 movable so as to remove the tubular workpiece A in a portion slightly upper than the stack plate 52 toward outside and a stacker air pipe 54 (FIG. 12) for applying air to the bottom edge part "a" of workpiece A at a timing slightly after the stacker bar 53 so that the workpiece A is hung on the stacker table 47 are employed. In FIGS. 1 and 10 to 12, a numeral 55 shows a space keeping mechanism connecting the frame base 40 of stacker 7 with the base 56 of sewing machine for adjusting a spacing between the bases 40, 56**, and fixing and holding them together.

An operation of the apparatus thus structured is described by referring to a time chart in FIG. 13.

Figure 10:
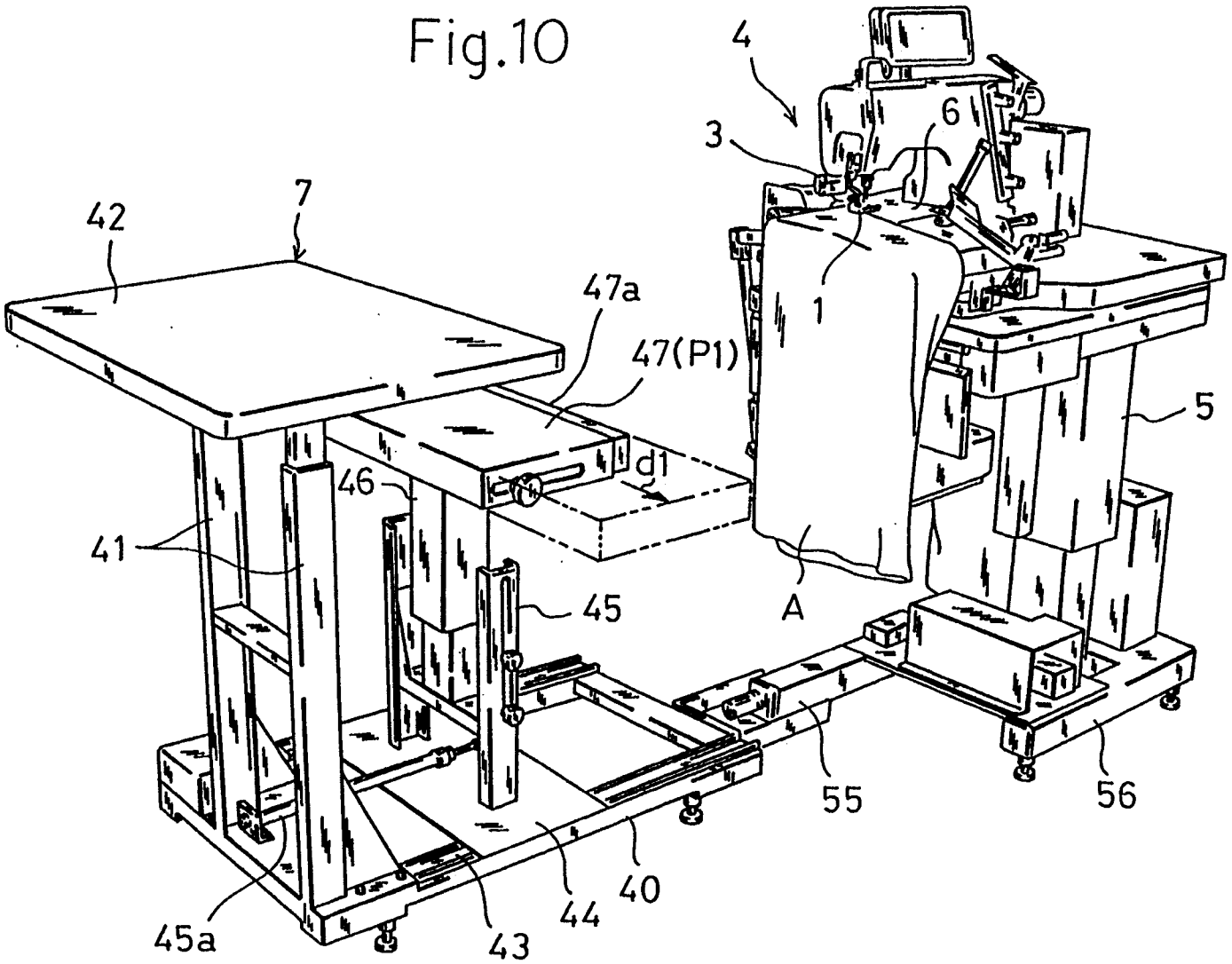
FIG. 10 is an overall perspective view for explaining an operation of a stacker in a first step.

With a stacker table 47 of stacker 7 positioned in its home position P1 shown by hatching in FIGS. 5 and 10, the tubular workpiece A is manually picked up from the workpiece stock table 42, and supplied by an operator in such manner that the front and rear support members 9, 11 are surrounded by the circular edge thereof (FIG. 7). As the workpiece A is applied, and the workpiece sensor 3 is turned on, the nip roller 13 is lowered by the air cylinder 12, and the belt cover plate 30 by the air cylinder 31 (FIG. 8).

In such state, upon turning on the start switch 38, the first and second feed motors 15, 29 are activated, the workpiece feeder 16 (10, 13) and assisting workpiece feeder belt 26 are driven, and the circular edge of workpiece A is transported about the sewing bed 6, while the sewing machine is inoperative. Here, the assisting workpiece feeder belt 26 serves for advancing the tubular workpiece A, and preventing it from escaping outwardly due to its own weight, and the entire workpiece A can be controlled in an appropriate attitude in the feeding direction by relatively changing a feeding speed of the second feed motor 29 according to a particular material and property of the workpiece A. The workpiece A is moved in the leftward (outside) direction, when the feeder belt 26 is operated at a higher speed than that of the roller 10, and in the rightward (inside) direction, when it is operated at a lower speed.

Immediately when the workpiece A is started to be fed in such manner, the air cylinders 18, 57 are activated, the workpiece guide 19, air blower 37 and OL sensor 36 are moved to the respective operating positions shown in FIG. 8, and the circular edge is folded over in a predetermined width. Then, a position of the edge a of workpiece A which is in transportation is detected by the edge sensor 17, the stepping motor 24 of roller angle changing mechanism 23 in the edge position controller 21 is rotated in one or the other direction depending on the detection signal from the sensor 17, and an inclination of the freely rotatable rollers 22A to 22D is changed in relation to the feeding direction of workpiece A. Thus, while the edge "a" of tubular workpiece A is controlled in position in the rightward or leftward direction, together with the feeding action of assisting workpiece feeder belt 26, it is adequately transported, and folded over to the inside of workpiece by the workpiece guide 19.

When the folded edge "a" is detected by the folding confirmation sensor 32, the first and second feed motor 15, 29 are stopped, and a folding process without sewing the workpiece is completed. In the folding process, the tubular workpiece A is folded over only in a part of the circular edge, and not required to be fold over in the entire circumference. Immediately after the motors are stopped, the presser foot 1 is lowered, and presses the workpiece A against the bed 6, then, as soon as the first and second feed motor 15, 29 are started, the workpiece feeding roller 10 and assisting workpiece feeder belt 26 are driven, and the tubular workpiece A is transported again along the sewing bed 6, the motor of sewing machine is started, and sewing of the folded edge "a" is initiated.

In the sewing process, similarly to the feeding process without sewing, the stepping motor 24 for the roller angle changing mechanism 23 in the edge position controller 21 is rotated in one or the other direction depending on a detection signal from the edge sensor 17 for detecting a position of the edge "a" of tubular workpiece A, and the position of the tubular workpiece A is automatically controlled in the leftward or rightward direction by changing the inclination of the plurality of freely rotatable rollers 22A to 22D against the feeding direction x of the workpiece, while the folded edge "a" is sewn through vertical motions of the sewing needles 2 with threads. Then, in the case the sewn edge "a" is detected by the OL sensor 36, the air cylinders 18, 57 are activated, the workpiece guide 19 and air blower 37 are shifted respectively from their operating position to the standby position, and the edge sensor 17 is shifted leftward by a folding width. A remaining part of the circumference is sewn continuously from the moment of such detection by the OL sensor 36 until the setting time is reached, then, after the setting time is elapsed, the feeding motors 15, 29 and the motor for the sewing machine 4 are stopped, the thread is cut, and the hemming operation is completed.

After completion of the hemming operation, the tubular workpiece A is removed to the stacker. Upon the detection by the OL sensor 36, shifting of the stacker table 47 is initiated in the direction shown by the arrow d1 in FIG. 5 by the air cylinder 50, in response to the detection signal from the sensor 36. Immediately after the hemming operation is completed, as shown in FIG. 11, a spreader bar 51*a* of the spreader device 51 is driven inner the tubular workpiece A, and spreads the rear end of tubular workpiece A in the back side thereof, and the intermediate portion of the tubular workpiece A is held between the presser plate 52 moved so as to project outside and the stacker table 47 simultaneously directed toward the receiving position P3 by the air cylinder 45*a*. In succession, as shown in FIG. 12, the stack bar 53 is driven outwardly as shown by an arrow y, then, slightly after it, air is applied to the edge a of tubular workpiece A, as shown in an arrow z, from the stacker air pipe 54. In such manner, the hemmed portion of tubular workpiece A is turned over, and the workpiece A is hung and held on the stacker table 47. Thereafter, as the spreader bar 51*a*, pressure plate 52, air cylinder 45*a* for the movable stand 44 and air cylinder 50 for stacker table 47 are simultaneously restored, the stacker table 47 is shifted diagonally, as shown by the arrow d3 in FIG. 5, from the receiving position P3, returned to the home position P1, and retained there until a succeeding sewing process is completed. Through such repetitive operational cycle of the stacker, the hemmed workpieces A are stacked on the stacker table 47 one after another.

When the spreader bar 53 is driven outwardly, as shown by the arrow y, the belt cover plate 30 is lifted by the air cylinder 31 so as to cover an edge of the belt to prevent it from obstructing the workpiece to be removed due to a friction between the workpiece and the belt 26. In the case such inclined surface 8*a* as shown in FIG. 3 is formed in an end outside the flat cylindrical cover 8 forming the front support member 9, application and setting the tubular workpiece A on the sewing bed 6 is facilitated, wrinkles caused in a hanging portion of the workpiece A are prevented from spreading onto the bed, and the workpiece can be smoothly fed.

What is claimed is:

1. An automatic hemming apparatus comprising a sewing machine with a sewing bed, support members provided horizontally in front and rear sides of the sewing bed, a workpiece feeder for transporting a tubular workpiece placed over the front and rear support members in a feeding direction along the sewing bed from the front to rear side thereof, an edge detecting sensor for detecting a circular edge of the tubular workpiece, a workpiece guide disposed between the sewing bed and the front support member for folding the circular edge to an inside of the tubular workpiece when the workpiece is transported in the feeding direction and an edge position controller placed in the vicinity of the front support member for controlling a position of the circular edge in a direction across the feeding direction of the workpiece, said automatic hemming apparatus further comprising an assisting workpiece feeder belt for feeding in the feeding direction identical to that of the workpiece feeder, means provided outside the sewing bed for driving said assisting workpiece feeder belt by a source different from that for driving the workpiece feeder, wherein the edge position controller comprises a plurality of freely rotatable rollers having circumferential surfaces inclined to the feeding direction of the workpiece, said rollers being placed in parallel with each other such that the circumferential surfaces thereof come in contact with the workpiece, and a roller angle changing mechanism for changing the inclination of the rollers according to a detection signal from the edge detecting sensor.

2. An automatic hemming apparatus according to claim 1, wherein the roller angle changing mechanism comprises a stepping motor and a link connecting a driving shaft of the stepping motor with respective support arms for the plurality of freely rotatable rollers.

3. An automatic hemming apparatus according to claim 1, said apparatus further comprising a movable belt cover provided outside the assisting workpiece feeder belt.

4. An automatic hemming apparatus according to claim said apparatus further comprising a stacker with a workpiece receiving table for stacking the hemmed workpiece discharged outside from the sewing machine, the stacker comprising a first mechanism for shifting the workpiece receiving table in a direction reverse to the feeding direction of a workpiece from a standby position outside and backwardly remote from the sewing machine to a position opposing to the sewing bed, a second mechanism for shifting the table from the opposing position to a position for receiving the hemmed workpiece.

5. An automatic hemming apparatus comprising a sewing machine with a sewing bed, support members provided horizontally in front and rear sides of the sewing bed, a workpiece feeder for transporting a tubular workpiece placed over the front and rear support members in a feeding direction along the sewing bed from the front to rear side thereof, an edge detecting sensor for detecting a circular edge of the tubular workpiece, a workpiece guide disposed between the sewing bed and the front support member for folding the circular edge to an inside of the tubular workpiece when the workpiece is transported in the feeding direction and an edge position controller placed in the vicinity of the front support member for controlling a position of the circular edge in a direction across the feeding direction of the workpiece, said automatic hemming apparatus further comprises a folding confirmation sensor for detecting that the circular edge is folded over by the workpiece guide and a driving member responsive to a detection signal from the folding confirmation sensor for moving said edge detecting sensor to a folded line detecting position.

* * * * *

UNITED STATES PATENT AND TRADEMARK OFFICE

CERTIFICATE OF CORRECTION

PATENT NO. : 5,383,410

DATED : January 24, 1995

INVENTOR(S) : Hirochika Mukai et al

It is certified that error appears in the above-identified patent and that said Letters Patent is hereby corrected as shown below:

Claim 4, column 9, line 4, "1," should be inserted between "claim" and "said".

Signed and Sealed this

Twenty-fifth Day of April, 1995

*Attest:*

Bruce Lehman

BRUCE LEHMAN

*Attesting Officer*

*Commissioner of Patents and Trademarks*